United States Patent [19]

Schwab

[11] 4,088,003

[45] May 9, 1978

[54] BLIND RIVETER

[75] Inventor: Manfred Schwab, Wiesbaden, Germany

[73] Assignee: Fa. Alfred Hansel, Nieten- und Metallwarenfabrik, Ruhr, Germany

[21] Appl. No.: 717,491

[22] Filed: Aug. 25, 1976

[30] Foreign Application Priority Data

Aug. 25, 1975 Germany ..... 2537792

[51] Int. Cl.[2] ..... B21J 15/34

[52] U.S. Cl. ..... 72/391; 72/453.17; 91/469

[58] Field of Search ..... 72/391, 453.17; 173/169; 91/469

[56] References Cited

U.S. PATENT DOCUMENTS

| | | | |
|---|---|---|---|
| 2,053,716 | 9/1936 | Huck | 173/169 |
| 2,134,735 | 11/1938 | Reinhold | 173/169 |
| 2,396,001 | 3/1946 | Fischer | 72/391 |
| 3,082,898 | 3/1963 | Bosch | 72/391 |

FOREIGN PATENT DOCUMENTS

| | | | |
|---|---|---|---|
| 2,028,725 | 12/1971 | Germany | 72/391 |

*Primary Examiner*—C.W. Lanham
*Assistant Examiner*—Gene P. Crosby
*Attorney, Agent, or Firm*—Christie, Parker & Hale

[57] ABSTRACT

A blind riveter comprises a chuck, a hydraulic system for moving the chuck, and a pneumatic system comprising a cylinder, a piston, a movable piston rod attached to the piston, a longitudinally slidable valve tappet, and valve means for a supply of compressed air. The longitudinal sliding of the valve tappet operates the valve to supply compressed air into the cylinder. The movable piston rod of the pneumatic system moves in the hydraulic system under the working stroke of the piston to effect movement of the chuck. The valve tappet, the cylinder, and the piston of the pneumatic system are each sealed parallel to their respective axis and are all interspersed longitudinally.

6 Claims, 2 Drawing Figures

BLIND RIVETER

BACKGROUND

Figure 1:
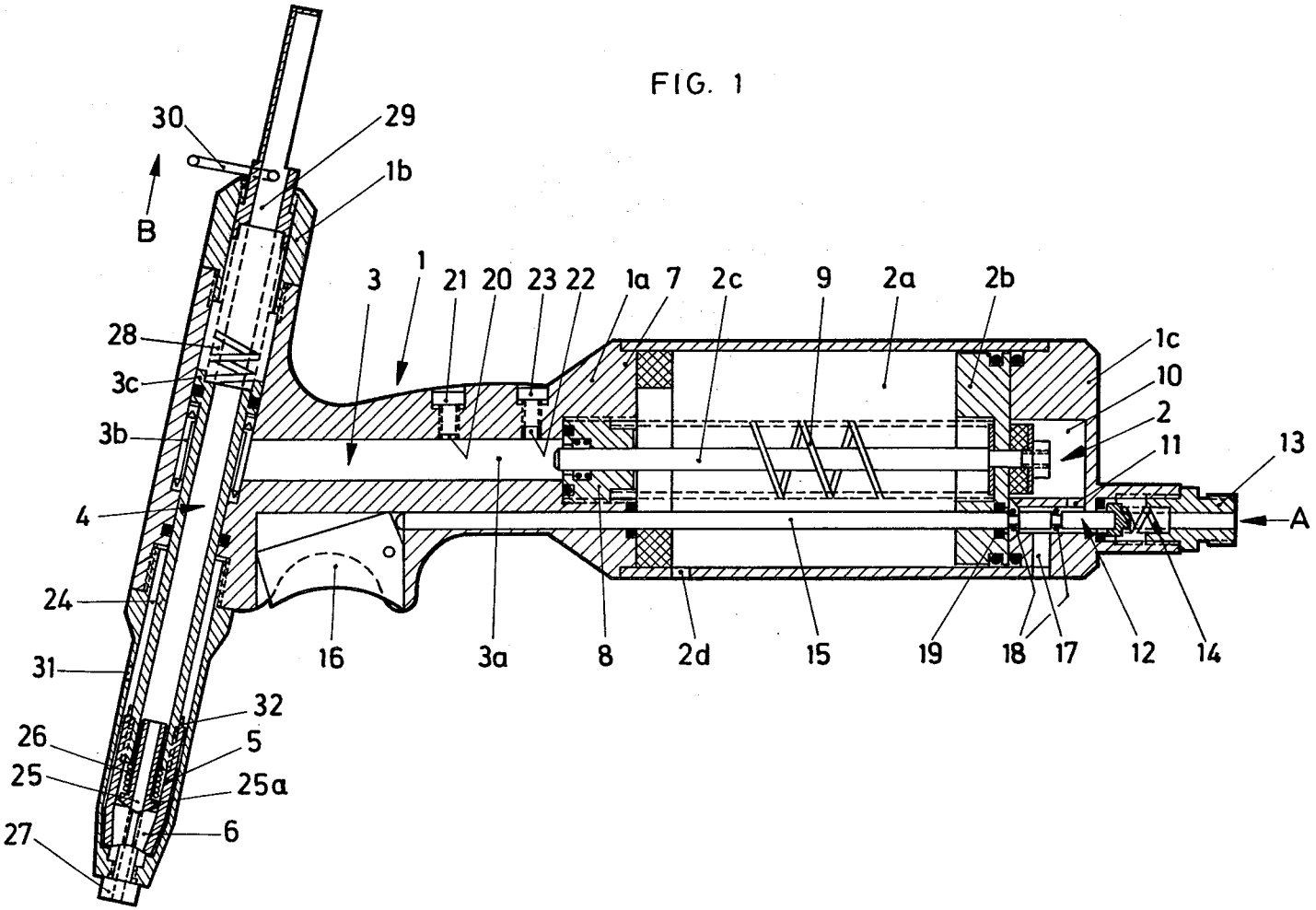

The invention concerns a blind riveter with a tension chuck, a hydraulic system for moving the tension chuck, and a pneumatic system with a cylinder and piston whereupon under power stroke of the piston a movable piston rod is moved in the hydraulic system, and with a valvular arrangement for the compressed air supply, which is operable through a longitudinally sliding valve tappet.

According to the German patent document No. 1,217,175, such a blind riveter is known. The arrangement of its valves, and valve tappet are accommodated in a region of the implement's casing, the region being essentially designed as a massive lateral extension of one piece continuous with the wall of the pneumatic cylinder. This region of the casing extends from the region of the inlet side of the pneumatic cylinder to almost its opposite side, whereby a portion of this addition is forked and serves as a swivel bearing for the operational element for the valve tappet. The remaining extension gives rise to a continuous longitudinal enlargement which diameter is stepped two times and which walled off end to the operational element transforms into a threaded sleeve into which a compressed air connection is screwed. The region of the largest diameter is linked up with the threaded sleeve in which a valve plate with play in all directions is accommodated. From the connecting middle section of the enlargement in the direction of the operational element, a slanting bore hole of proper diameter is in position to pass through the extension of the casing into the inside of the cylinder. The remaining portion of the enlargement corresponds to the thickness of the valve tappet in the sliding seat fit. The valve tappet is designed as a tube, both sides being open, one of which however the walling is pulled in and serves to brace a tension spring, which is accommodated inside the tube. The spring butts against the valve plate through the opposite end of the tube. On the opposite surface of the valve plate, a spring of that kind in the compressed air connection acts, in its resting position, so that the valve plate presses on the passage between the region of the enlargement with the middle and largest diameter, so that it rests thereagainst in an airtight manner. By swiveling of the operational element this spring becomes compressed so that the free end of the valve tappet pushes against the valve disc and shoves this so far that compressed air reaches into the middle region of the enlargement, around the valve disc, and reaches the inside of the cylinder through the bore hole. Thereby the piston of the pneumatic system is set in motion, influences the hydraulic system and causes a blind rivet to be set. As soon as the operational element is released, the spring in the valve tappet can push this away from the valve plate. The opposing spring becomes activated and closes the compressed air supply. Simultaneously, the pressure in the hydraulic system becomes equalized through the return set spring, and the piston of the pneumatic system is pushed back. The compressed air in the cylinder of the pneumatic system between the piston and the hydraulic system can escape through an exit aperture. The air behind the piston, compressed through the return motion, logically then in the end of the cylinder, can escape through the slanted bore hole, the middle section of the clearance and the interspace between the valve plate and the end of the valve tappet. The additional casing outside the pneumatic cylinder of this known implement represents an enlargement of its bulk and increase of its weight. The latter becomes especially uncomfortably noticeable as moment of stress by the appearance of fatigue through the arrangement at the end of the casing, i.e., the farthest possible distance from that region which is handled by the operator. In the fabrication the form of the casing is expensive due to the stepped clearance and especially because of the slanting bore holes. The out flow of air created by the returning piston found on the backside thereof becomes impeded through the arrangement of the end of the valve tappet serving as an out flow aperture on the operational element, and results in resistance to the return motion, which is undesirable on the known blind riveter, since the entire return set motion there is conducted by one single spring.

The task of this invention is to create a blind riveter of previous described type, which arrangement of valves and tappets is simple and is arranged without additional weight and increased dimensions.

SUMMARY

Accordingly, the task is accomplished by a valve tappet, which extends through the piston of a pneumatic system in a sealing and longitudinal sliding manner, and extends parallel to the axis of a cylinder of the pneumatic system.

A large portion of the length of the valve tappet is accommodated freely in the inside of the cylinder. Thereby, the entire room in this region of the casing, and thus a large diameter, is available for the cylinder. This permits a higher pressure buildup under the same dimensions. Further, the casing and thereby the implement in this realm are comfortably light, so that handling causes less fatigue. The necessary clearance in the casing for the movement of the valve tappet and the entire arrangement of the valves can be designed in the form of simple bore holes of the same diameter — is also then economically manufacturable.

The arrangement of valves can be designed advantageously within the circumference of the cylinder. The simple straight line course of the valve tappet, as well as the other valve components remain unchanged, without the casing necessitating on the side an extension or sundries. The casing retains the same even outside form, which is simple and economical in the fabrication and easy and handy to use.

For the return motion, the cylinder of the pneumatic system can have in the region of the compressed air supply an exit aperture to the atmosphere which is coverable by the valve tappet. Since it can run vertical to the wall, it is easy to mount and causes no added expenses to the fabrication. The departing air passes only a short distance with few curves, the aperture opening to the outside is clear. The return motion of the piston can therefore be rapid and without resistance.

In the preferred type of design, two ring seals are mounted on the valve tappet, spaced apart by a distance exceeding the diameter of the exit aperture. Thereby, the exit aperture can be definitely opened and closed by simple means, i.e., through the position of the valve tappet.

DRAWINGS

Figure 2:
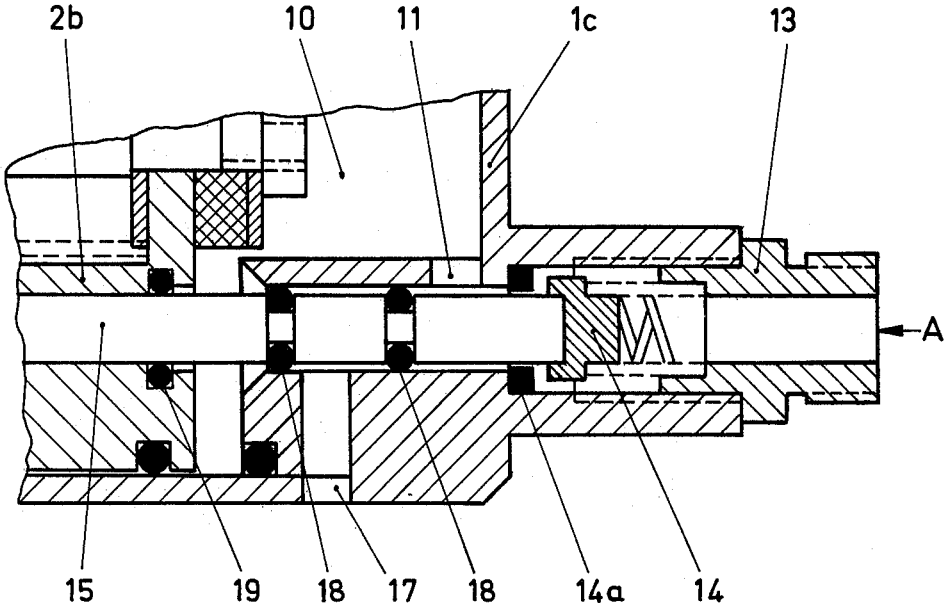

Further details of the invention are subsequently described on the basis of the illustration. Shown are:

FIG. 1 is a sectional drawing of a blinder riveter while in its resting position; and FIG. 2 is an enlargement of its valvular arrangement in a working position.

DESCRIPTION

The blind riveter represented in FIG. 1 has a casing 1 with an operational component 1*a*, and a working component 1*b* which extends almost vertical to the operational component. In the operational component 1*a* is a complete unit accommodated, comprising a pneumatic system designated with 2 and the most essential elements of a hydraulic system designated with 3. The working component 1*b* contains a mechanism for motion 4 for a chuck 5 with chuck jaws 6.

The pneumatic system has cylinder 2*a*, which wall for the most part is constructed from the operational component 1*a* of the casing. A longitudinal sliding piston 2*b* is arranged in cylinder 2*a*. The face of the piston towards the region of the end of the casing is hittable with compressed air. A piston rod 2*c* is attached centrally to the other face of the piston and is axially aligned with the cylinder. The front wall 7 of the cylinder 2*a* opposite the piston is continuous with the casing in one piece and contains centrally a sealing unit 8, wherethrough the piston rod 2*c* penetrates centrally. Its end projects into a hydraulic tube 3*a* which diameter exceeds that of the piston rod 2*c*, which however amounts to less than the diameter of the cylinder 2*a* of the pneumatic system. Further, a coil spring 9 is mounted in the cylinder 2*a* of the pneumatic system which in a resting position loads the piston 2*b* in a direction toward the end of the casing 1*c*, near the end of the cylinder. The casing 1, in its end region 1*c*, forms a chamber 10 with an aperture to the cylinder 2*a*, which is covered by the piston when in its resting position, and with an inlet aperture 11 to a valvular system, which as complete unit is designated with 12. Thereto belongs a connecting piece 13 for a compressed air line, not shown, a spring loaded inlet valve 14, a valve tappet 15, which by means of a handle 16 is axially movable against the inlet valve 14 which opens against the pressure of its spring, as well as an exit aperture 17 in the end region of the casing 1*c*, and two ring seals 18 working together with the outlet aperture, arranged around the valve tappet with spacing therebetween. An enlargement of this region in the working position is shown in FIG. 2.

The valve tappet 15 penetrates through the cylinder 2*a* parallel to piston rod 2*c*, whereby one end projects into the valvular system in the described manner, and the other end protrudingly arranged, longitudinally sliding, through the front wall 7 and there butts against the swivelably arranged handle 16. Further, the valve tappet 15 penetrates a sealed sealing ring 19 and the piston 2*b*, whereby the valve tappet and the piston are reciprocally longitudinally slidable.

The hydraulic system 3, has, in the region of the casing 1*a*, a filling aperture 20 opening into the hydraulic tube 3*a* with a lock screw 21 and neighboring thereby a ventilation aperture 22 with a lock screw 23. The ventilation aperture 22 opens in a region of the casing 1 toward the outside, which is slightly thicker than the region where the filling aperture 20 opens.

The hydraulic tube 3*a* opens into a hydraulic cylinder 3*b* which wall essentially belongs to the working component 1*b* of the casing. A ring shaped piston 3*c* is arranged there in a slidable manner. It is connected in one piece together with a tube 24, which on its end farthest from the piston is screwed firmly together with a chuck 5. The chuck 5, conically shaped on its free end, inside and out, encloses chuck jaws 6 which is as well conically designed. A fastener 25 with an essentially tube shaped body is arranged with one end longitudinally slidable in the tube 24, the other end has a rotating conical flange 25*a* on the front side, which pushes against the chuck jaws 6, loaded by the compression spring 26, which props on the reverse side of the flange 25*a*, and again against the front surface of the tube 24. The free ends of chuck jaws 6 are propped against a nozzle 27, which is attached in the casing.

A return spring 28 touches the opposite side of the hydraulic piston 3*c* of the hydraulic cylinder. The other end rests against an abutment 29 which is screwed into the casing 1*b* in a longitudinal adjustable manner. The handle 30 is intended for adjustments.

A viewing window 31 in the configuration of a small opening is intended in the casing 1*b*, roughly in the middle between the working end of the working component 1*b* and the end of the cylinder faced thereto. In the general region of the connection between the chuck 5 and the tube 24 a ring shaped marking 32 in an eye catching color is to be applied to the tube 24.

The mode of operation of the described blind riveter is as follows: The FIG. 1 shows the resting position, in which the air pressure valve 14 is closed by its spring, the piston 2*b* of the pneumatic system is held in position near the end of the casing 1*c* by a coil spring 9, and the piston 3*c* of the hydraulic installation is being pushed in the direction of the working end of the working component 1*b* of the casing by the return spring 28. Depending upon the initial tension of the return spring 28 by the abutment 29, the chuck 5 is pushed over chuck jaws 6 and presses this more or less together. You can in this manner hold an inserted tension shaft of a blind rivet. In such an event, this must be inserted against the strength of the compression spring 26. As the blind rivet is inserted into the intended opening, on which edge of the nozzle 27 props, the handle 16 is swiveled. Thereby, it pressures the valve tappet 15 against the spring loaded inlet valve 14 so that this opens by moving from its valve seat 14*a*.

Compressed air can reach via the direction of arrow A through the inlet aperture 11 into the chamber 10 behind the pneumatic piston 2*b*. With the sliding of the valve tappet 15 both ring seals 18 arrive at a position on both sides of the exit aperture 17, so that the compressed air of chamber 10 cannot reach the outlet aperture. It pushes the piston 2*b*, on the contrary, against the force of the coil spring 9 in such a manner that the piston rod 2*c* plunges into the hydraulic tube 3*a*. In this manner, the pressure in the closed hydraulic system 3 increases. Through the increased pressure, the ring piston 3*c* is pushed against the return spring 28 in the direction of the arrow B. Automatically, tube 24 transfers this motion to the chuck 5. This on one hand takes the chuck jaws 6 with it, whereby the action of the conical surfaces together compresses even more, since chuck jaws cannot follow immediately due to the friction of motion with the tension shaft of a blind rivet. By the further course of the piston stroke the chuck jaws are carried along and transfer the tension to the tension shaft which on the other hand in the known manner, deforms the rivet head and finally tears away at the intended breaking off site. The torn off shaft-end can reach the outside of the casing of the implement through the axially aligned bore holes of the chuck jaws, of the fasteners, of the tube 24 and finally as well of the tube shaped abutment 29. As soon as the person operating the implement perceives the jolt under the tearing off of the tension shaft and releases the handle 16, valve 14 closes by its spring, during which the valve tappet moves back to the starting position. Thereby, air can pass through an outlet aperture **2*d* into the cylinder directly from the outside, and compressed air can pass out of chamber 10, which has become larger through the stroke of the piston, sideways around the protruding portion of the valve tappet in this chamber to flow outside through the exit aperture 17. Piston 2*b* is moved in its resting position by coil spring 9. Simultaneously with the reduction of pressure in the hydraulic tube 3*a*, the return spring 28 moves the piston 3*c*** back into the starting position.

The viewing window 31 and the marking 32 are arranged in the working component **1*b* of the casing in such a manner that the axial distance in the resting position corresponds to a theoretical established work stroke as minimal limit. During the normal work stroke the marking therefore passes by the viewing window 31 completely out of sight. As soon as the pressure buildup in the hydraulic system is reduced, due to a loss in leaks, etc., to the extent to be only efficient enough to maintain the established work stroke, the marking in viewing window 31 remains visual during the process of work. This is an indication for the person operating the implement, that the hydraulic medium must be replenished. For replenishing hydraulic system 3 the lock screws 21 and 23** of the fill- and ventilation apertures have to be unscrewed. Hydraulic medium is to be filled through the filling aperture until it runs out of the slightly higher opening of the ventilation aperture. Thereby, it is guaranteed that no remaining air will be found in the hydraulic system. The lock screws can be reinserted.

The invention is not limited to the example in the design. The arrangement and the type of action of the handle imposed on the valve tappet can vary, for example, the handle can be placed closer to the cylinder space and the valve tappet shortened accordingly. Details of the valve seats as well as the inlet and outlet apertures in relationship to the valve tappet can vary as long as the sealing organization is mounted in an appropriate manner.

I claim:

1. In a blind riveter comprising a chuck, a hydraulic system for moving the chuck, and a pneumatic system comprising a cylinder, a piston, a movable piston rod attached to the piston, a longitudinally slidable valve tappet, and valve means for a supply of compressed air, the valve means being operable by the longitudinal sliding of the valve tappet to supply compressed air into the cylinder, wherein the movable piston rod of the pneumatic system moves in the hydraulic system under the working stroke of the piston for activating the hydraulic system to move the chuck, the improvement comprising that the valve tappet intersperses the cylinder and the piston of the pneumatic system and extends parallel to the longitudinal axis of the cylinder and the piston, wherein said valve tappet penetrates the walls of said cylinder and said piston and is surrounded by sealing means where it penetrates through the walls of said cylinder and said piston.

2. The blind riveter of claim 1 in which the valve means is located within a chamber of the cylinder of the pneumatic system, said chamber being on the side of the piston opposite the side of the piston to which the piston rod is attached.

3. The blind riveter of claim 2 comprising in addition an exit aperture to the atmosphere through the cylinder of the pneumatic system in the region of the compressed air supply for passing air from the cylinder to the atmosphere, wherein the exit aperture is closable by the valve tappet directly.

4. The blind riveter of claim 3 comprising in addition two ring seals mounted on the valve tappet and spaced apart by a distance exceeding the diameter of the exit aperture for closing the exit aperture.

5. The blind riveter of claim 1 comprising in addition an exit aperture to the atmosphere through the cylinder of the pneumatic system in the region of the compressed air supply for passing air from the cylinder to the atmosphere, wherein the exit aperture is closable by the valve tappet directly.

6. The blind riveter of claim 5 comprising in addition two ring seals mounted on the valve tappet and spaced apart by a distance exceeding the diameter of the exit aperture for closing the exit aperture.

* * * * *